US008056737B2

(12) United States Patent
Kao

(10) Patent No.: US 8,056,737 B2
(45) Date of Patent: Nov. 15, 2011

(54) SCREWDRIVER HOLDER

(76) Inventor: Jui-Chien Kao, Tali (TW)

( * ) Notice: Subject to any disclaimer, the term of this patent is extended or adjusted under 35 U.S.C. 154(b) by 326 days.

(21) Appl. No.: 12/488,939

(22) Filed: Jun. 22, 2009

(65) Prior Publication Data

US 2010/0320162 A1 Dec. 23, 2010

(51) Int. Cl.
*A47F 7/00* (2006.01)

(52) U.S. Cl. ..... 211/70.6

(58) Field of Classification Search ..... 211/70.6, 211/60.1, 63, 66, 69, 70.8, 89.01; 206/376, 206/377, 379, 349, 372, 375; 248/220.21, 248/220.31

See application file for complete search history.

(56) References Cited

U.S. PATENT DOCUMENTS

| | | | | |
|---|---|---|---|---|
| 3,482,705 | A * | 12/1969 | Bushey | 211/60.1 |
| 6,595,376 | B1 * | 7/2003 | Lin | 211/70.6 |
| 6,719,155 | B1 * | 4/2004 | Chang | 211/70.6 |
| 7,077,275 | B2 * | 7/2006 | Kao | 211/70.6 |
| 7,204,374 | B2 * | 4/2007 | Marek | 211/70.6 |
| 7,258,239 | B2 * | 8/2007 | Kao | 211/70.6 |
| 7,503,459 | B2 * | 3/2009 | Grayson | 211/70.8 |
| 2004/0144739 | A1 * | 7/2004 | Marek | 211/70.6 |
| 2008/0023420 | A1 * | 1/2008 | Kao | 211/70.6 |
| 2008/0047911 | A1 * | 2/2008 | Kao | 211/70.6 |

FOREIGN PATENT DOCUMENTS

DE 3819360 A1 * 12/1989

* cited by examiner

*Primary Examiner* — Darnell Jayne
*Assistant Examiner* — Stanton L Krycinski
(74) *Attorney, Agent, or Firm* — C. G. Mersereau; Nikolai & Mersereau, P.A.

(57) ABSTRACT

A screwdriver holder has a base and a holding bar. The base has a protrusion, a bottom board, a hanging seat and at least one hanging hole and may have multiple insert holes. The protrusion protrudes from the bottom board. The hanging seat is formed on or protruded along an edge of the bottom board. The at least one hanging hole is defined through the hanging seat. The multiple insert holes of the base are defined through the protrusion and the bottom board. The holding bar has a bottom surface or a side surface attached to the protrusion. The holding bar may have multiple pairs of aligned insert holes or multiple insert holes aligned with the insert holes of the base.

4 Claims, 12 Drawing Sheets

SCREWDRIVER HOLDER

BACKGROUND OF THE INVENTION

1. Field of the Invention

The present invention relates to a holder for hand tools, and more particularly to a screwdriver holder.

2. Description of Related Art

A screwdriver holder is always mounted on a tool trolley and has multiple insert holes in which multiple screwdrivers are inserted and held.

However, each screwdriver is held only by a corresponding insert hole, the screwdriver is easily swaying and can not be held stably.

To overcome the shortcomings, the present invention tends to provide a screwdriver holder to mitigate or obviate the aforementioned problems.

SUMMARY OF THE INVENTION

A screwdriver holder has a base and a holding bar. The base has a protrusion, a bottom board, a hanging seat, at least one hanging hole and multiple insert holes. The protrusion protrudes from the bottom board. The hanging seat is formed on or protruded along an edge of the bottom board. At least one hanging hole is defined through the hanging seat. The multiple insert holes of the base are defined through the protrusion and the bottom board. The holding bar has a bottom surface or a side surface attached to the protrusion. The holding bar may have multiple pairs of aligned insert holes or multiple insert holes aligned with the insert holes of the base.

Other objects, advantages and novel features of the invention will become more apparent from the following detailed description when taken in conjunction with the accompanying drawings.

DETAILED DESCRIPTION OF PREFERRED EMBODIMENT

Figure 1:
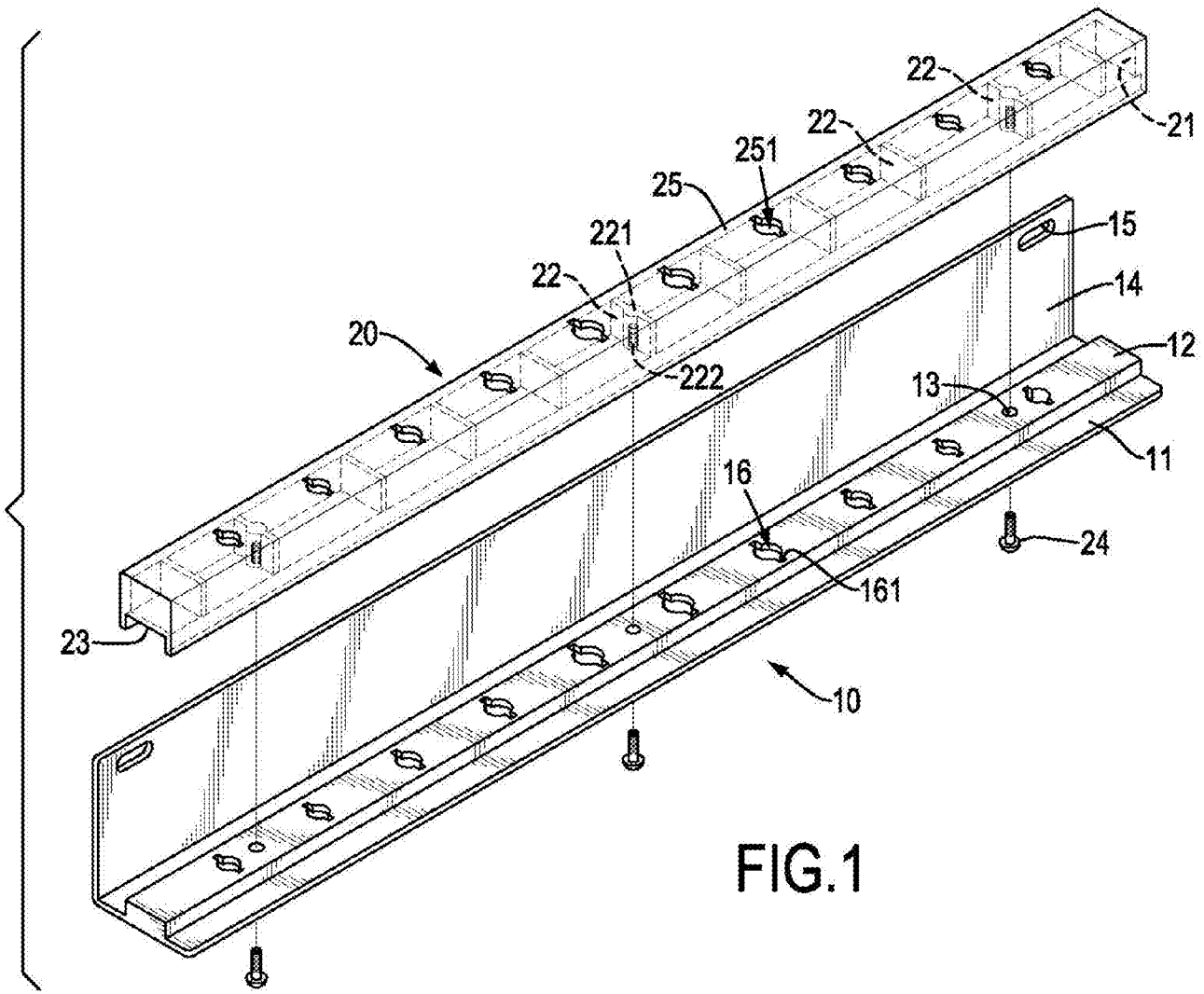
FIG. 1 is an exploded perspective view of a first embodiment of a screwdriver holder in accordance with the present invention.
Figure 2:
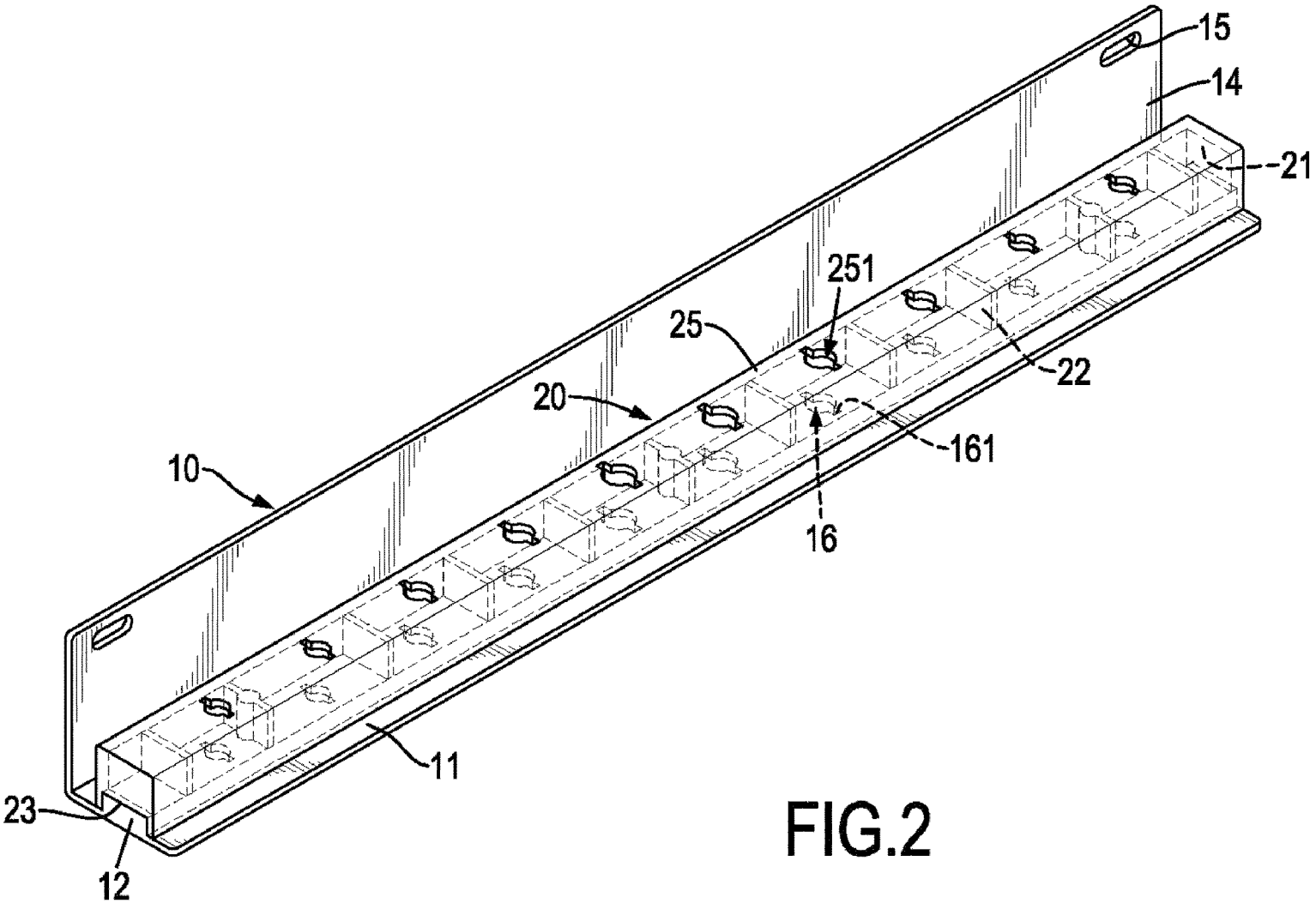
FIG. 2 is a perspective view of the screwdriver holder in FIG. 1.

With reference to FIGS. 1 and 2, a screwdriver holder in accordance with the present invention comprises a base (10) and a holding bar (20).

The base (10) has a bottom board (11), a protrusion (12), multiple through holes (13), a hanging seat (14), at least one hanging hole (15) and multiple insert holes (16). The bottom board (11) may be rectangular and has a mounting surface, a securing surface opposite to the mounting surface and an edge. The protrusion (12) is formed on and protrudes from the mounting surface of the bottom board (11) and has a middle and to ends. The multiple through holes (13) are defined through the protrusion (12) and the bottom board (11). In a preferred embodiment, the base (10) has three through holes (13) respectively defined at positions on the middle and near the two ends of the protrusion (12). The hanging seat (14) has a length same as that of the bottom board (11) may be perpendicularly formed on the edge of the bottom board (11) and has two ends. The at least one hanging hole (15) may be elongated and is defined through the hanging seat (14). The hanging seat (14) may have two hanging holes (15) 23 defined near the two ends of the hanging seat (14). The multiple insert holes (16) 24 of the base (10) are defined separately through both of the protrusion (12) and the bottom board (11). Each insert hole (16) of the base (10) comprises a circular hole and two insert trenches (161). The circular hole has an inner surface. The two insert trenches (161) are oppositely formed in the inner surface of the circular hole. A width of the insert trench (161) is smaller than a diameter of the circular hole.

The holding bar (20) is attached and corresponds to the protrusion (12), may be rectangular and has a bottom surface, a top surface (25), a chamber (21), multiple sheets (22), a channel (23) and multiple screws (24). The bottom surface is attached to the bottom board (11) of the base (10). The chamber (21) is defined in the holding bar (20). The multiple sheets (22) are separately mounted in the chamber (21). Three of the multiple sheets (22) are respectively aligned with and connected to the three through holes (13) of the base (10). Each of the sheets that align with the through holes (13) has a pillar (221), a middle and a screw hole (222). The pillar (221) is hollow, is formed on the middle of the sheet (22) and has an end facing the bottom surface of the holding bar (20). The screw hole (222) is formed in the end of the pillar (221) and aligns with a corresponding through hole (13). The channel (23) is defined in the bottom surface, communicates with the chamber (21) and the multiple screw holes (222) and is mounted around the protrusion (12). Each screw (24) is mounted through one of the through holes (13) and is screwed into a corresponding one of the screw holes (222) from the securing surface of the bottom board (11) to secure combine the holding bar (20) with the protrusion (12). The top surface (25) is opposite to the bottom surface and has multiple insert holes (251). The multiple insert holes (251) are defined through the top surface (25) at positions separated from the multiple sheets (22) and are respectively aligned with the multiple insert holes (16) of the base (10). A shape of the insert holes (251) of the top surface (25) are the same as the insert holes (16) of the base (10), and each insert hole (251) has a circular hole and two insert trenches.

Figure 3:
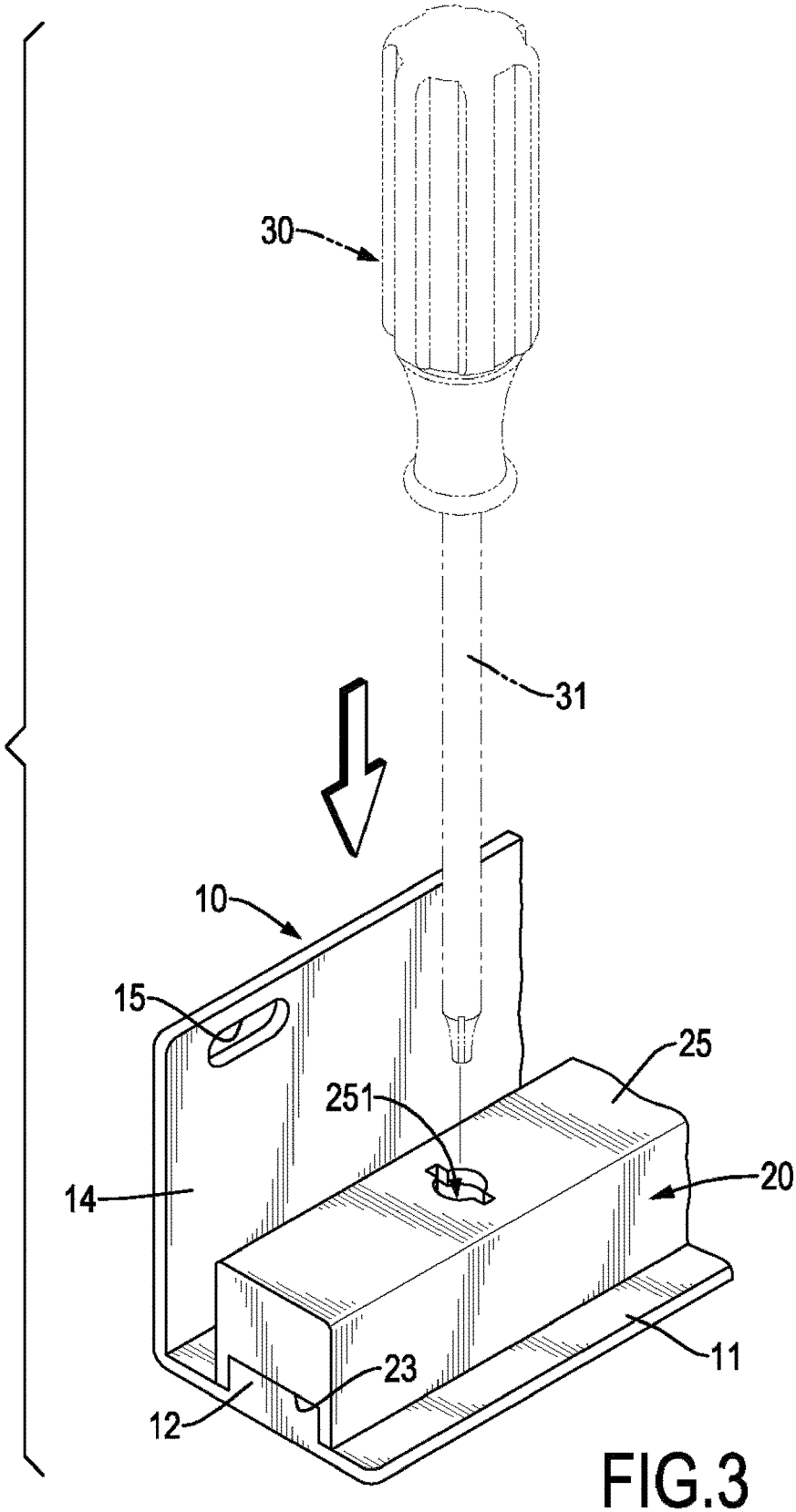
FIG. 3 is an enlarged operational perspective view of the screwdriver holder in FIG. 1.
Figure 4:
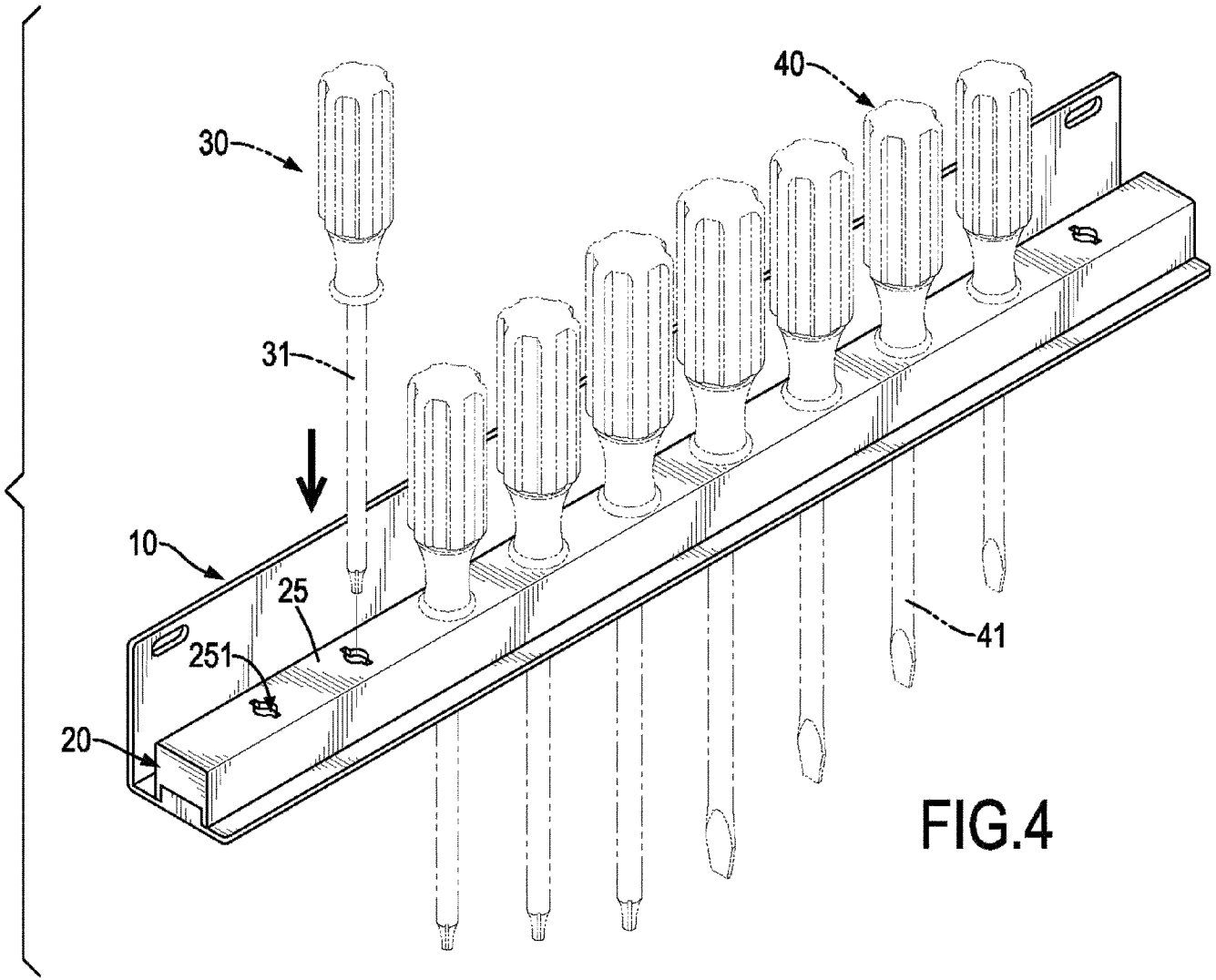
FIG. 4 is an operational perspective view of the screwdriver holder in FIG. 1.
Figure 5:
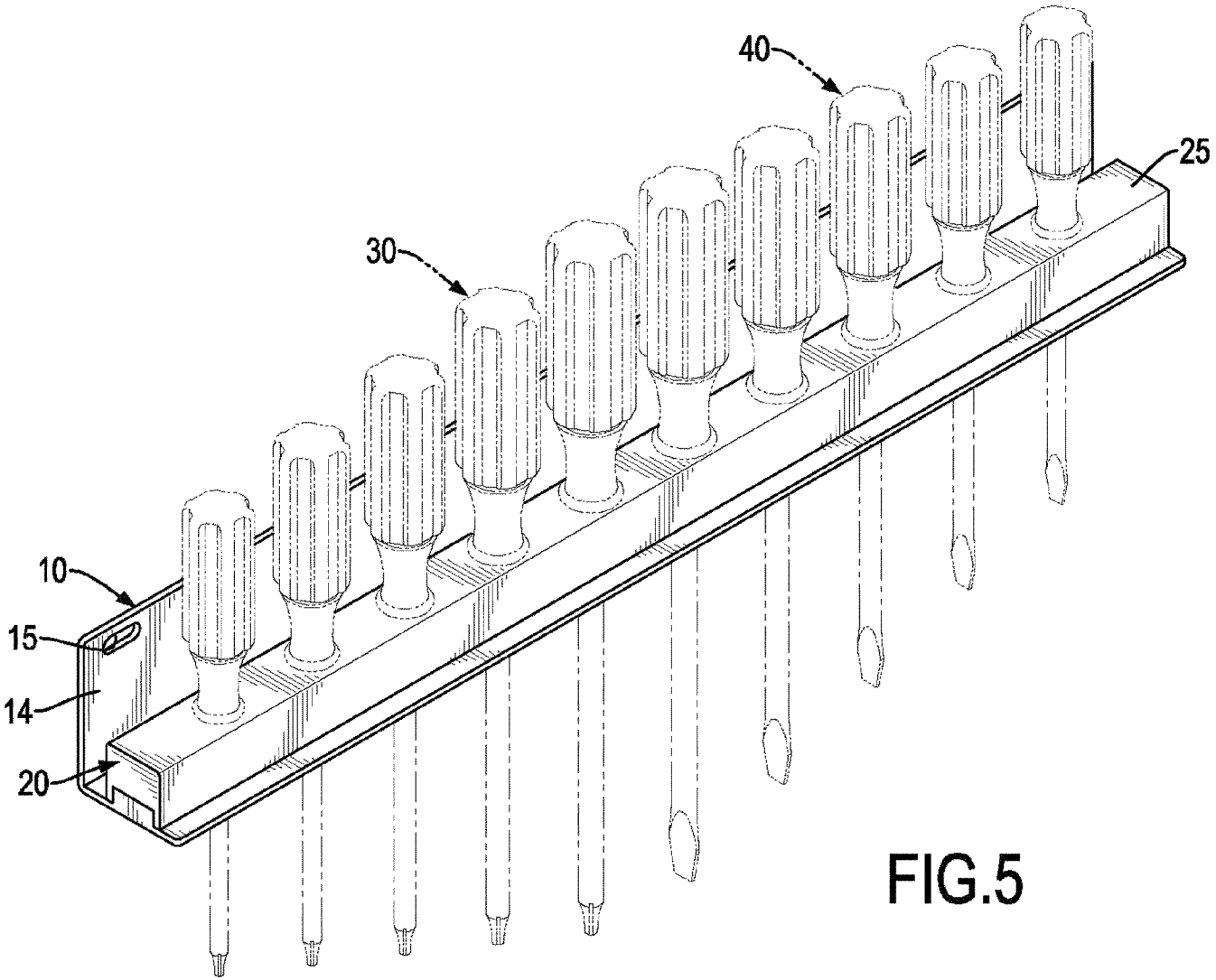
FIG. 5 is an operational perspective view of the screwdriver holder in FIG. 1 showing multiple screwdrivers being held on the screwdriver holder.

With further reference to FIGS. 3, 4 and 5 the screwdriver holder may be mounted on a wall with at least one fastener mounted through the at least one hanging hole (15). When a screwdriver (30) is held on the screwdriver holder, a shaft (31) of the screwdriver (30) is held by two separate points that are one of the insert holes (16) of the base (10) and a corresponding insert hole (251) in the holding bar (20). The screwdriver holder in accordance with the present invention has increased holding, area for holding the shaft (31) of the screwdriver (30) to hold the screwdriver (30) stably and keep the screwdriver (30) from swaying.

Figure 6:
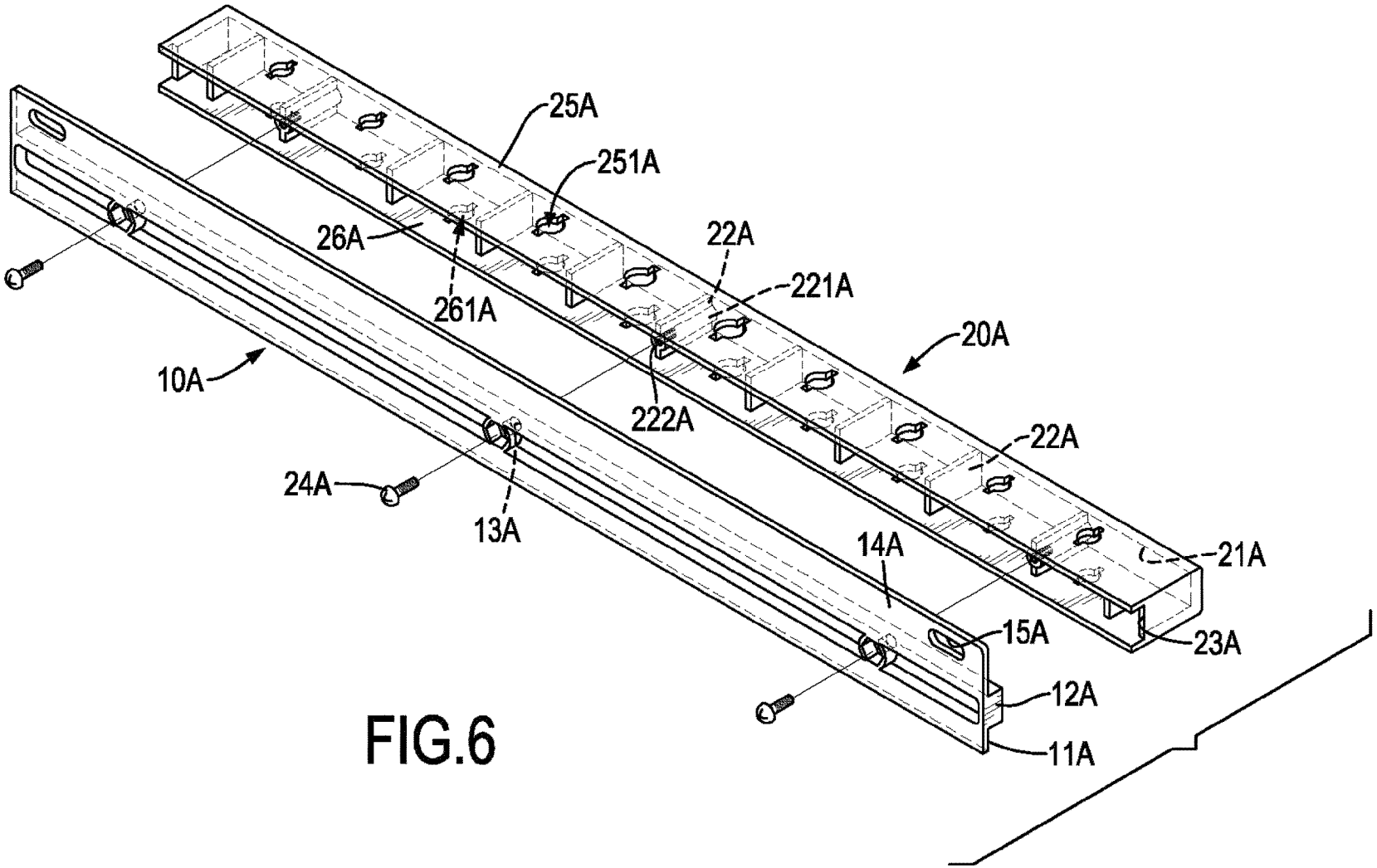
FIG. 6 is an exploded perspective view of a second embodiment of a screwdriver holder in accordance with the present invention.
Figure 7:
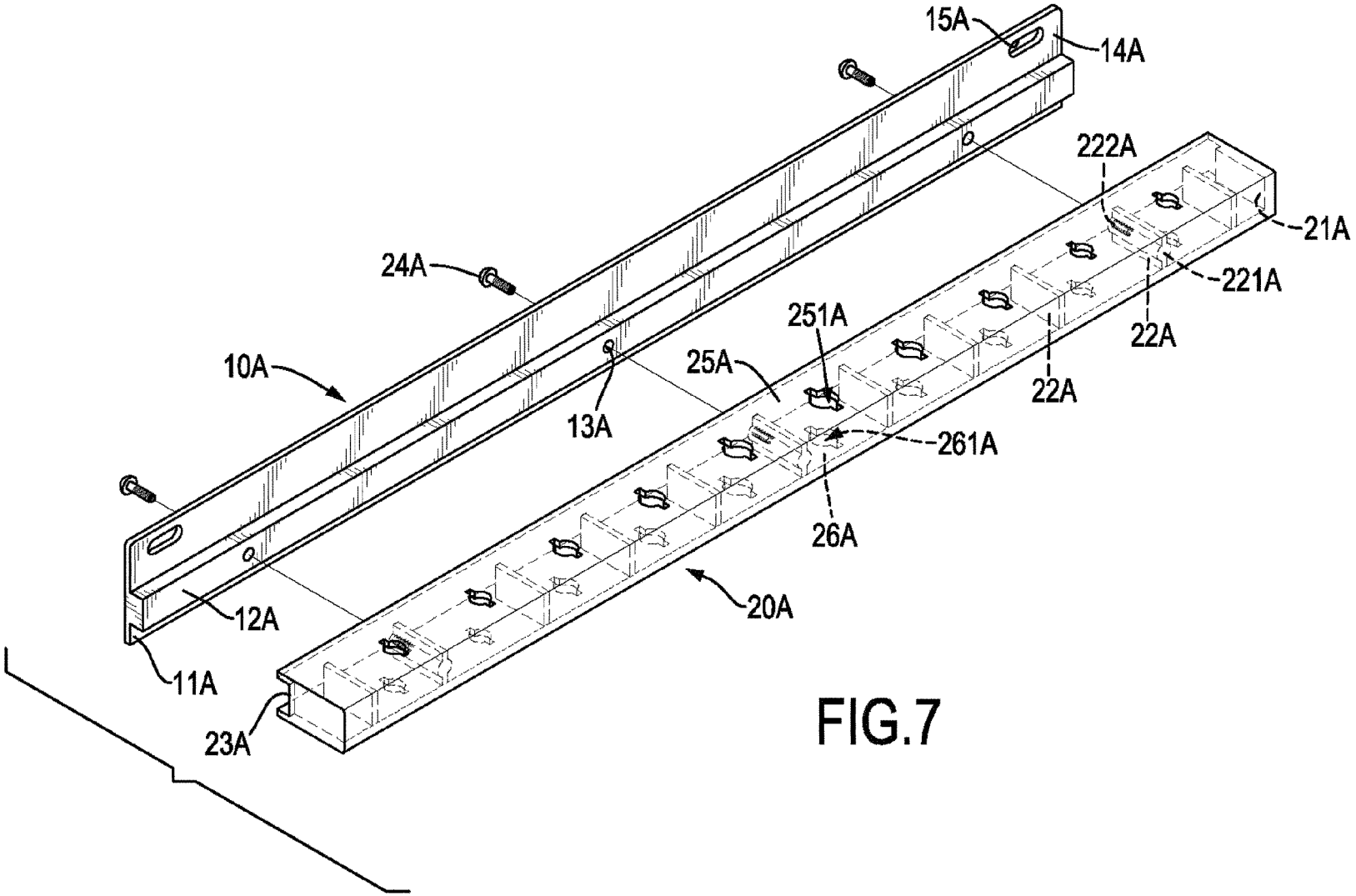
FIG. 7 is an exploded perspective view of the screwdriver holder in FIG. 6.

With further reference to FIGS. 6 and 7, in the second embodiment, a screwdriver holder comprises a base (10A) and a holding bar (20A).

The base (10A) has a bottom board (11A), a protrusion (12A), multiple through holes (13A), a hanging seat (14A) and at least one hanging hole (15A). The bottom board (11A) may be rectangular and has a mounting surface, a securing surface opposite to the mounting surface and an edge. The protrusion (12A) is formed on and protrudes from the mounting surface of the bottom board (11A) and has a middle and two ends. The multiple through holes (13A) are defined through the protrusion (12A) and the bottom board (11A). In a preferred embodiment, the base (10A) has three through holes (13A) respectively defined at positions on the middle and near the two ends of the protrusion (12A). The hanging seat (14A) has a length same as that of the bottom board (11A) may be protruded along the edge of the bottom board (11A) and has two ends. The at least one hanging hole (15A) may be elongated and is defined through the hanging seat (14A). The hanging seat (14A) may have two hanging holes (15A) defined near the two ends of the hanging seat (14A).

The holding bar (20A) is attached and corresponds to the protrusion (12A), may be rectangular and has a side surface, a chamber (21A), multiple sheets (22A), a channel (23A), multiple screws (24A), a bottom surface (26A) and a top surface (25A). The side surface is attached to the bottom board (11A) of the base (10A). The chamber (21A) is defined in the holding bar (20A). The multiple sheets (22A) are separately mounted in the chamber (21A). Three of the multiple sheets (22A) are respectively aligned with and connected to the through holes (13A) of the base (10A). Each of the sheets that align with the through holes (13A) has a middle, a pillar (221A) and a screw hole (222A). The pillar (221A) is hollow, is formed on the middle of the sheet and has an end facing the side surface of the holding bar (20A). The screw hole (222A) is formed in the end of the pillar (221A) and aligns with a corresponding through hole (13A). The channel (23A) is defined in the side surface, communicates with the chamber (21A) and the screw holes (222A) and is mounted around the protrusion (12A). Each screw (24A) is mounted through one of the through holes (13A) and is screwed into a corresponding one of the screw holes (222A) from the securing surface of the bottom board (11A). The bottom surface (26A) has multiple insert holes (261A). The multiple insert holes (261A) of the bottom surface (26A) are defined through the bottom surface (26A). Each insert hole (261A) of the bottom surface (26A) comprises a circular hole and two insert trenches. The circular hole has an inner surface. The insert trenches are oppositely formed in the inner surface of the circular hole. The width of the insert trench is smaller than the diameter of the circular hole. The top surface (25A) is opposite to the bottom surface (26A) and has multiple insert holes (251A). The multiple insert holes (251A) are defined through the top surface (25A) and are respectively aligned with the insert holes (261A) in the bottom surface (26A). A shape of the insert holes (251A) in the top surface (25A) are the same as the multiple insert holes (261A) of the bottom surface (26A), and each insert hole (251A) of the top surface (25A) has a circular hole and two insert trenches.

Figure 8:
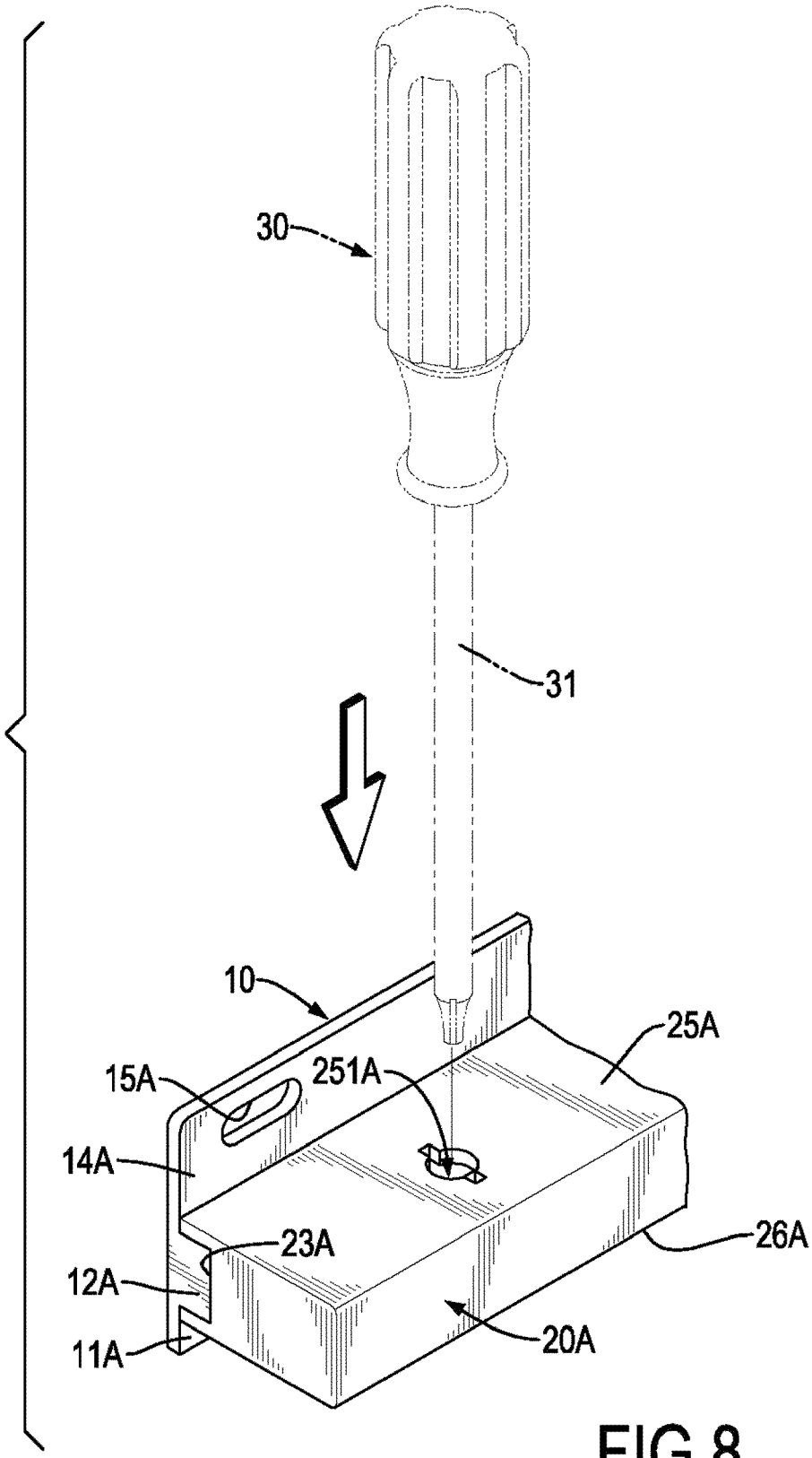
FIG. 8 is an enlarged operational perspective view of the screwdriver holder in FIG. 6.
Figure 9:
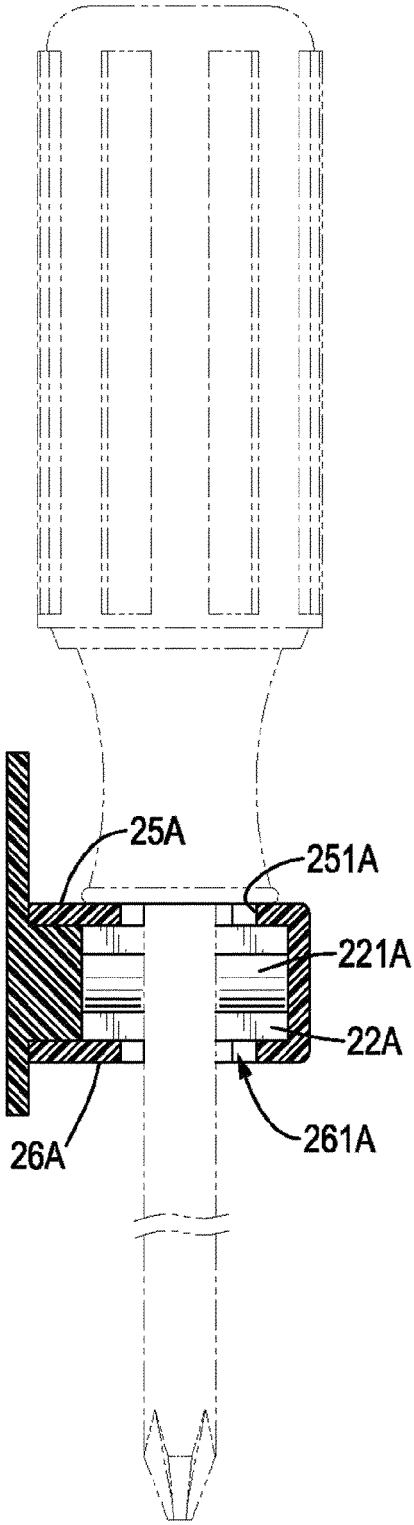
FIG. 9 is an enlarge side view in partial section of the screwdriver holder in FIG. 6.
Figure 10:
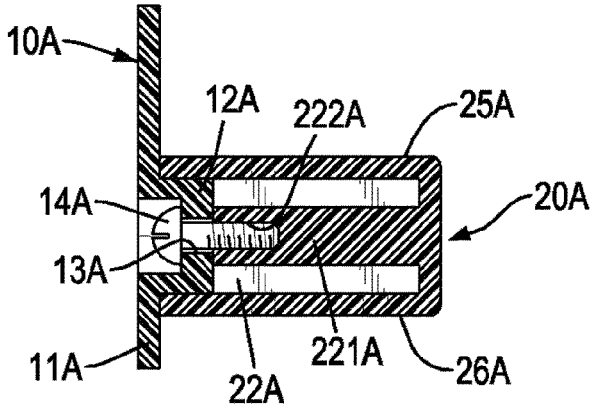
FIG. 10 is an enlarge side view in partial section of the screwdriver holder in FIG. 6.

With further reference to FIGS. 8, 9 and 10, the screwdriver holder may be mounted on a wall with at least one fastener mounted through the at least one hanging hole (15A). When the screwdriver (30) is held on the screwdriver holder, the shaft (31) of the screwdriver (30) is held by two separate points that are one of the insert holes (261A) in the bottom surface (26A) and a corresponding insert hole (251A) in the top surface (25A). Accordingly, a screwdriver (30) can be held stably with an increased holding area of the screwdriver holder and be kept from swaying.

Figure 11:
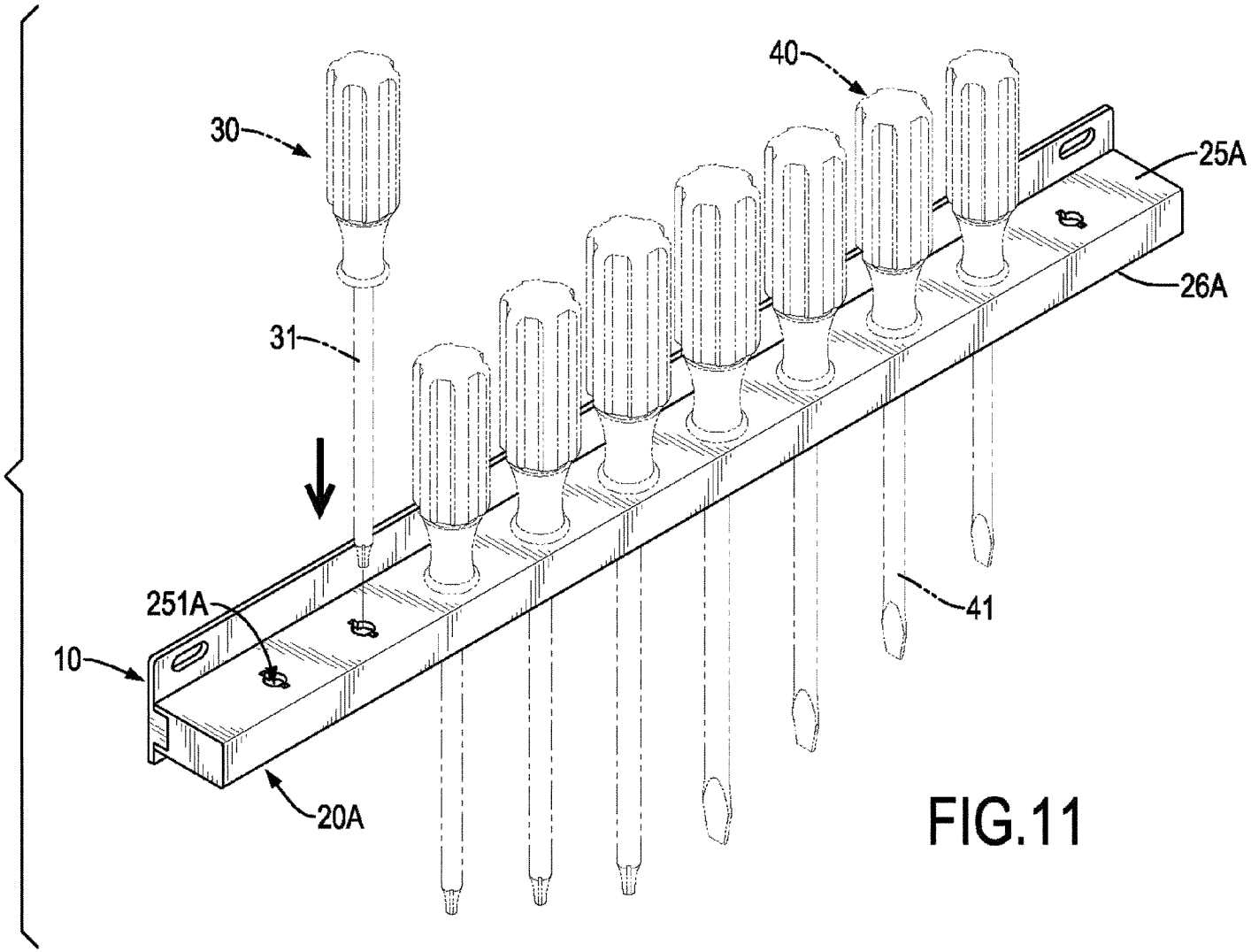
FIG. 11 is an operational perspective view of the screwdriver holder in FIG. 6.
Figure 12:
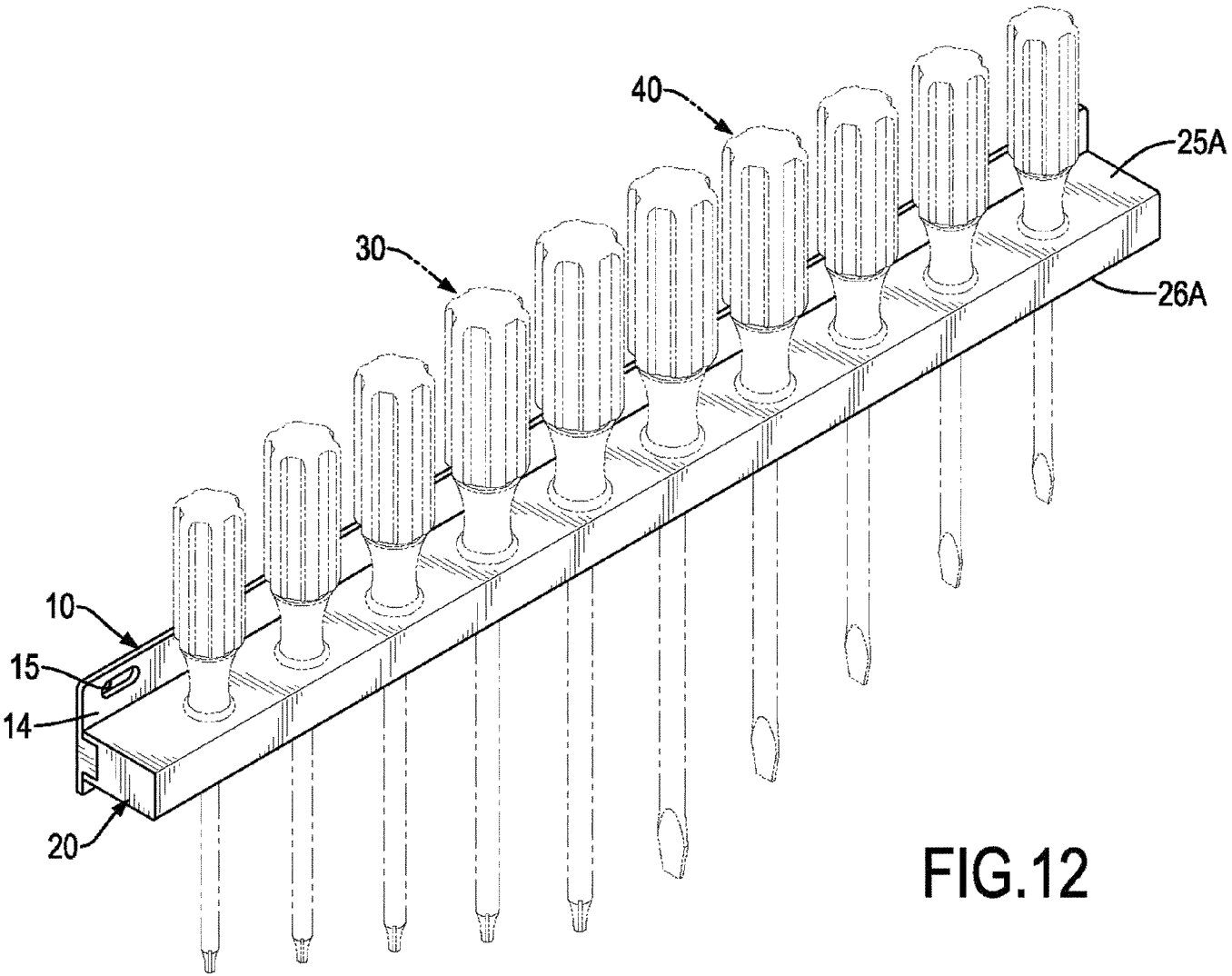
FIG. 12 is an operational perspective view of the screwdriver holder in FIG. 6 showing multiple screwdrivers being held on the screwdriver holder.
Figure 13:
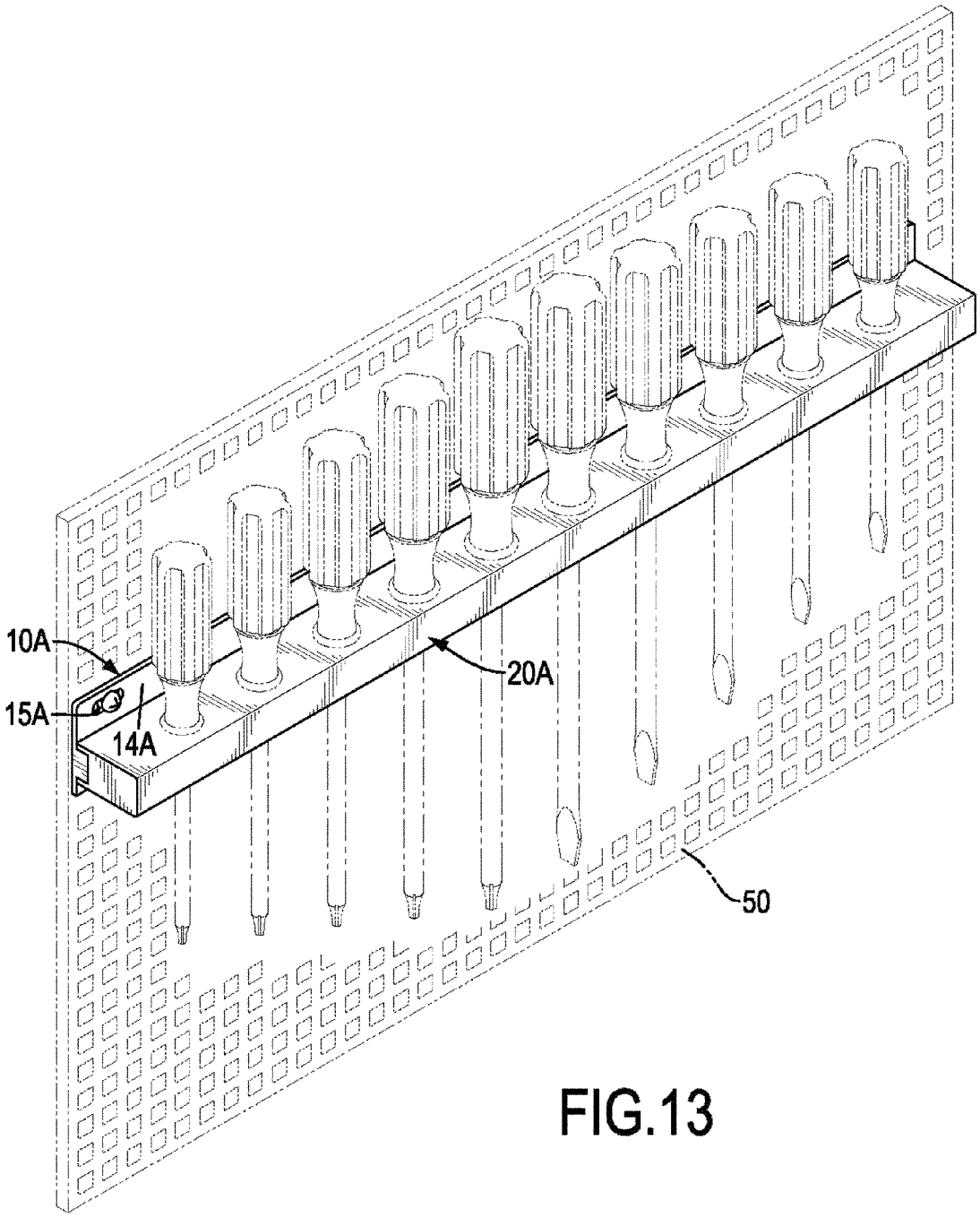
FIG. 13 is an operational perspective view of the screwdriver holder in FIG. 6 showing the screwdriver holder being mounted on a board.

With further reference to FIGS. 11, 12 and 13, the screwdriver holder may be mounted on a wall or a peg board (50) with at least one fastener mounted through the at least one hanging hole (15A). A shaft (41) of a flat head screwdriver (40) can be inserted into one pair of aligned insert holes (251A, 261A) with two edges of the flat head extending through the insert trenches, and the flat head screwdriver (40) is then rotated to make the edges of the flat head misaligning from the insert trenches. Because a width of the flat head screwdriver (40) is larger than a diameter of the circular hole, the flat head screwdriver (40) can be kept from being detached from the multiple insert holes and be held in stable.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A screwdriver holder comprising:

a base having a bottom board having a mounting surface, a securing surface being opposite to the mounting surface and an edge;

a protrusion formed on and protruded from the mounting surface of the bottom board;

a hanging seat having a length same as the bottom board, perpendicularly formed on the edge of the bottom board and having two ends;

at least one through hole being defined through the protrusion and the bottom board;

at least one hanging hole defined through the hanging seat;

multiple insert holes defined separately through both of the protrusion and the bottom board, and each insert hole having a circular hole having an inner surface and a diameter; and two insert trenches oppositely formed in the inner surface of the circular hole and each having a width smaller than the diameter of the circular hole;

a holding bar being attached to the protrusion and having a bottom surface attached to the bottom board;

a chamber defined in the holding bar;

multiple sheets separately mounted in the chamber, at least one of the sheets respectively aligning with and connected to the at least one through hole of the base, and each one of the at least one sheet aligning with the at least one through hole having a middle;

a pillar being hollow and formed on the middle of the sheet and having an end facing the bottom surface of the holding bar;

a screw hole formed in the end of the pillar and being aligned with a corresponding one of the at least one through hole;

a channel defined in the bottom surface, communicating with the chamber and mounted around the protrusion;

at least one screw mounted respectively through the at least one through hole and screwed into the at least one screw hole in the at least one sheet aligning with the at least one through hole from the securing surface of the bottom board;

a top surface being opposite to the bottom surface, having multiple insert holes defined through the top surface at positions separated from the multiple sheets, respectively aligned with the insert holes in the base and each having a shape same as that of the insert holes in the base.

2. The screwdriver holder as claimed in claim 1, wherein the bottom board of the base is rectangular and has two hanging holes defined respectively near the two ends of the hanging seat.

3. A screwdriver holder comprising:

a base having a bottom board having a mounting surface, a securing surface opposite to the mounting surface and an edge;

a protrusion formed on and being protruding from the mounting surface of the bottom board;

a hanging seat having a length same as the bottom board, protruded along the edge of the bottom board and having two ends.

at least one through hole being defined through the protrusion and the bottom board;

at least one hanging hole defined through the hanging seat;

a holding bar being attached to the protrusion and having a side surface attached to the bottom board of the base;

a chamber defined in the holding bar;

multiple sheets separately mounted in the chamber, at least one of the sheets aligning with and connected to the at least one through hole of the base, and each one of the at least one sheet aligning with the at least one through hole having a middle;

a pillar being hollow and formed on the middle of the sheet and having an end facing the side surface of the holding bar;

a screw hole formed in the end of the pillar and aligning with the one of the at least one through hole;

a channel defined in the side surface, communicating with the chamber and mounted around the protrusion;

at least one screw mounted respectively through the at least one through hole and screwed into the at least one screw hole in the at least one sheet aligning with the at least one through hole from the securing surface of the bottom board;

a bottom surface having multiple insert holes defined though the bottom surface at positions separated from the multiple sheets, and each insert hole of the bottom surface having a circular hole having an inner surface and a diameter; and two insert trenches oppositely formed in the inner surface of the circular hole and each having a width being smaller than the diameter of the circular hole;

a top surface being opposite to the bottom surface, having multiple insert holes defined through the top surface and respectively aligned with the insert holes of the bottom surface and each having a shape same as that of the insert holes in the bottom surface.

4. The screwdriver holder as claimed in claim 3, wherein the bottom board of the base is a rectangular and the base has two hanging holes defined respectively near the two ends of the hanging seat.

* * * * *